US006601660B1

(12) United States Patent
Xiang et al.

(10) Patent No.: US 6,601,660 B1
(45) Date of Patent: Aug. 5, 2003

(54) CUTTING STRUCTURE FOR ROLLER CONE DRILL BITS

(75) Inventors: Ying Xiang, The Woodlands, TX (US); Amardeep Singh, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 7 days.

(21) Appl. No.: 09/589,999

(22) Filed: Jun. 8, 2000

(51) Int. Cl.[7] ..... E21B 10/08
(52) U.S. Cl. ..... 175/341; 175/420.1
(58) Field of Search ..... 175/331, 338, 175/341, 420.1

(56) References Cited

U.S. PATENT DOCUMENTS

| | | | | | |
|---|---|---|---|---|---|
| 4,408,671 | A | | 10/1983 | Munson | 175/377 |
| 4,611,673 | A | | 9/1986 | Childers et al. | 175/340 |
| 4,657,093 | A | | 4/1987 | Schumacher | 175/353 |
| 4,673,044 | A | * | 6/1987 | Bigelow et al. | 175/329 |
| 4,848,476 | A | | 7/1989 | Deane et al. | 175/340 |
| 4,928,521 | A | * | 5/1990 | Jardine | 73/151 |
| 5,372,210 | A | | 12/1994 | Harrell | 175/431 |
| 5,394,952 | A | | 3/1995 | Johns et al. | 175/332 |
| 5,579,856 | A | * | 12/1996 | Bird | 175/375 |
| 5,813,480 | A | | 9/1998 | Zaleski, Jr. et al. | 175/40 |
| 6,057,784 | A | | 5/2000 | Schaaf et al. | 340/854.4 |
| 6,095,262 | A | * | 8/2000 | Chen | 175/57 |
| 6,170,583 | B1 | * | 1/2001 | Boyce | 175/426 |
| 6,213,225 | B1 | | 4/2001 | Chen | 175/57 |
| 6,401,839 | B1 | | 6/2002 | Chen | 175/57 |
| 6,412,577 | B1 | | 7/2002 | Chen | 175/57 |

FOREIGN PATENT DOCUMENTS

| | | |
|---|---|---|
| WO | WO 00/12859 | 3/2000 |
| WO | WO 00/12860 | 3/2000 |

OTHER PUBLICATIONS

Ma Dekun et al., "The Operational Mechanics of the Rock Bit", Petroleum Industry Press, 1996, pp. 1–243.

Society of Petroleum Engineers Paper No. 29922, "The Computer Simulation of the Interaction Between Roller Bit and Rock", Dekun Ma, et al, presented Nov. 14–17, 1995, 9 pages.

Society of Petroleum Engineers Paper No. 56439, "Field Investigation of the Effects of Stick–Slip, Lateral, and Whirl Vibrations on Roller Cone Bit Performance", S. L. Chen et al, presented Oct. 3–6, 1999, 10 pages.

(List continued on next page.)

*Primary Examiner*—David Bagnell
*Assistant Examiner*—Jennifer R. Dougherty
(74) *Attorney, Agent, or Firm*—Rosenthal & Osha L.L.P.

(57) ABSTRACT

Cutting structures for roller cone drill bits are disclosed. One aspect is a drill bit which includes a bit body, and a plurality of roller cones attached to the bit body and able to rotate with respect to the bit body. The bit further includes a plurality of cutting elements arranged on each of the roller cones so that cutting elements on adjacent cones intermesh between the adjacent cones. The cutting elements are arranged so that a rotation speed of each cone differs by less than about 7% from the rotation speed of each of the other cones during drilling. Another aspect is a drill bit which includes a bit body, and a plurality of roller cones attached to the bit body and able to rotate with respect to the bit body. The bit also includes a plurality of cutting elements arranged on each of the roller cones so that cutting elements on adjacent cones intermesh between the adjacent cones. In this aspect, at least one of the cutting elements on each cone comprises a gage cutting element, and the gage cutting elements on each cone are arranged so that the scraping distance of the gage cutting elements on each cone is substantially the same as the scraping distance of the gage cutting elements on each of the other cones.

30 Claims, 8 Drawing Sheets

OTHER PUBLICATIONS

Society of Petroleum Engineers Paper No. 71053, "Development and Application of a New Roller Cone Bit with Optimized Tooth Orientation", S. L. Chen et al., presented May 21–23, 2001, 15 pages.

Society of Petroleum Engineers Paper No. 71393, "Development and Field Applications of Roller Cone Bits with Balanced Cutting Structure", S. L. Chen et al., presented Sep. 30–Oct. 3, 2001, 11 pages.

* cited by examiner

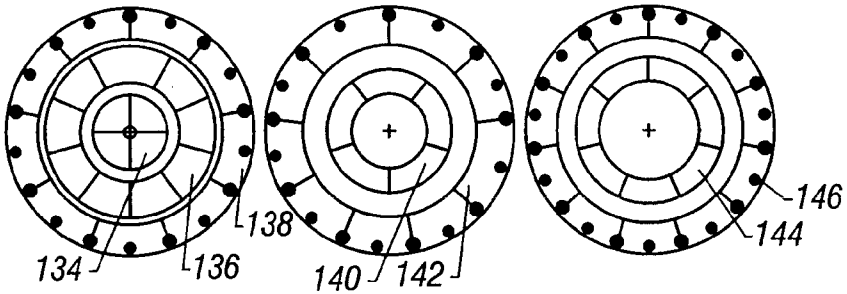

| | CONE | ROW | # TEETH | SPACING | INCLINATION ANGLE | TOOTH ANGLE | TOOTH WIDTH INNER END ② | TOOTH WIDTH OUTER END 3 | ROOT ANGLE | END MILL CUTTER ANGLE | END MILL CUTTER RADIUS | SPECIAL INSTRUCTIONS |
|---|---|---|---|---|---|---|---|---|---|---|---|---|
| 120 | | A | 4 | 4 | 19.49° | 40.00° | .06 | .06 | 16.69° | 120.00° | .125 R | SEE DIAGRAM FOR ORIENTATION |
| 122 | 1 | B | 9 | 19 | 31.89° | 43.00° | .09 | .09 | 18.33° | 75.00° | .250 R | ONE 1-1/2 P (SEE DIAGRAM FOR PLACEMENT) |
| 124 | | C | 9 | 18 | 11.99° | 43.00° | .14 | .14 | 10.53° | 62.50° | .125 R | DELETE EVERY OTHER TOOTH WITH 45° x .750 ED x .250 R CUTTER • 15.0° ROOT. MILL AXIS ⊥ TO TOOTH ROOT. STOP CUTTER PRIOR TO CONTACTING TEETH ON "B" ROW. |
| 126 | | A | 5 | 5 | 24.69° | 43.00° | .09 | .09 | 19.50° | 105.00° | .125 R | SEE DIAGRAM FOR ORIENTATION |
| 128 | 2 | B | 9 | 30 | 17.46° | 43.00° | .09 | .15 | 13.39° | 77.50° | .625 R / .375 R | THREE 1-1/3 P (SEE DIAGRAM FOR PLACEMENT) MILL FIRST PASS COMPLETELY THRU WITH .625 R CUTTER. MILL SECOND PASS WITH .375 R CUTTER AND STOP CUTTER PER PRINT. BLEND CUTS AS CLOSE AS POSSIBLE. |
| 130 | | A | 7 | 7 | 32.20° | 43.00° | .09 | .09 | 22.85° | 85.00° | .375 R | SEE DIAGRAM FOR ORIENTATION |
| 132 | 3 | B | 11 | 11 | 11.21° | 43.00° | .12 | .12 | 8.96° | 75.00° | .563 R / .250 R | MILL FIRST PASS COMPLETELY THRU WITH .563 R CUTTER. MILL SECOND PASS WITH .250 R CUTTER AND STOP CUTTER PER PRINT. BLEND CUTS AS CLOSE AS POSSIBLE. |

*FIG. 3C*
*(Prior Art)*

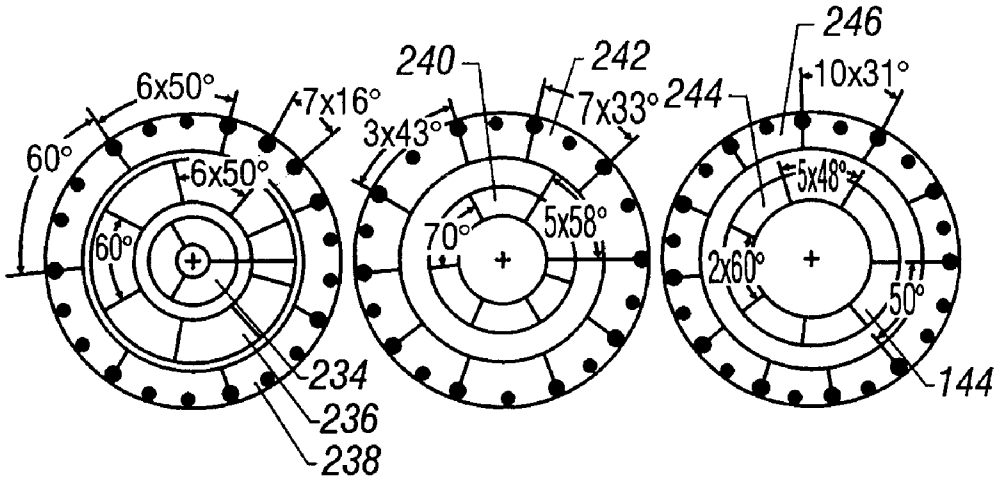

| CONE | ROW | # TEETH | PITCH SPACING | TOOTH ANGLE | TOOTH WIDTH INNER END ② | TOOTH WIDTH OUTER END 3 | ROOT ANGLE | RADIUS | SPECIAL INSTRUCTIONS |
|---|---|---|---|---|---|---|---|---|---|
| | A | 3 | 3x120° | 43.00° | .09 | .09 | 16.69° | .125 R | SEE DIAGRAM FOR ORIENTATION |
| 1 | B | 7 | 6x50°;1x60° | 43.00° | .09 | .09 | 18.33° | .250 R | SEE DIAGRAM FOR ORIENTATION |
| | C | 7 | 6x50°;1x60° | 43.00° | .12 | .12 | 10.53° | .250 R | SEE DIAGRAM FOR ORIENTATION |
| | A | 6 | 5x58°;1x70° | 43.00° | .14 | .14 | 19.50° | .125 R | SEE DIAGRAM FOR ORIENTATION |
| 2 | B | 10 | 7x33°;3x43° | 43.00° | .12 | .12 | 13.39° | .188 R | SEE DIAGRAM FOR ORIENTATION |
| | A | 7 | 5x48°;2x60° | 43.00° | .09 | .09 | 22.85° | .188 R | SEE DIAGRAM FOR ORIENTATION |
| 3 | B | 11 | 10x31°;1x50° | 43.00° | .12 | .12 | 8.96° | .125 R | SEE DIAGRAM FOR ORIENTATION |

220 222 224 226 228 230 232

FIG. 6

CUTTING STRUCTURE FOR ROLLER CONE DRILL BITS

BACKGROUND OF THE INVENTION

1. Technical Field

The invention relates generally to roller cone drill bits for drilling earth formations, and more specifically to roller cone drill bit designs.

2. Background Art

Roller cone rock bits and fixed cutter bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a well bore 14. Connected to the end of the drill string 12 is a roller cone-type drill bit 20, shown in further detail in FIG. 2.

Referring to FIG. 2, roller cone drill bits 20 typically comprise a bit body 22 having an externally threaded connection at one end 24, and a plurality of roller cones 26 (usually three as shown) attached at the other end of the bit body 22. The cones 26 are able to rotate with respect to the bit body 22. Disposed on each of the cones 26 of the bit 20 is a plurality of cutting elements 28 typically arranged in rows about the surface of each cone 26. The cutting elements 28 may be tungsten carbide inserts, superhard inserts such as polycrystalline diamond compacts, or milled steel teeth with or without hardface coating.

The cutting elements 28 on a cone 26 may include primary cutting elements, gage cutting elements, and ridge cutting elements. Primary cutting elements are the cutting elements arranged on the surface of the cone such that they contact the bottomhole surface as the bit is rotated to cut through the formation. Gage cutting elements are the cutting elements arranged on the surface of the cone to scrape the side wall of the hole to maintain a desired diameter of the hole as the formation is drilled. Ridge cutting elements are miniature cutting elements typically located between primary cutting elements to cut formation ridges that may pass between the primary cutting elements to protect the cones and minimize wear on the cones due to contact with the formation.

Significant expense is involved in the design and manufacture of drill bits to produce bits which have increased drilling efficiency and longevity. For more simple bit designs, such as those for fixed cutter bits, models have been developed and used to design and analyze bit configurations which exhibit balanced forces on the individual cutting elements of the bit during drilling. Fixed cutter bits designed using these models have been shown to provide faster penetration and long life.

Roller cone bits are more complex than fixed cutter bits, in that the cutting surfaces of the bit are disposed on roller cones, wherein each roller cone independently rotates relative to the rotation of the bit body about an axis oblique to the axis of the bit body. Because the cones rotate independently of each other, the rotational speed of each cone of the bit is likely different from the rotation speed of the other cones. The rotation speed for each cone of a bit can be determined from the rotational speed of the bit and the effective radius of the "drive row" of the cone. The effective radius of the drive row is generally related to the radial extent of the cutting elements that extend axially the farthest from the axis of rotation of the cone, these cutting elements generally being located on a so-called "drive row". Adding to the complexity of roller cone bit designs, the cutting elements disposed on the cones of the roller cone bit deform the earth formation by a combination of compressive fracturing and shearing. Additionally, most modern roller cone bit designs have cutting elements arranged on each cone so that cutting elements on adjacent cones intermesh between the adjacent cones, as shown for example in FIG. 3A and further detailed in U.S. Pat. No. 5,372,210 to Harrell. Intermeshing cutting elements on roller cone bits is desired to permit high insert protrusion to achieve competitive rates of penetration while preserving the longevity of the bit. However, intermeshing cutting elements on roller cone bits constrains cutting element layout on the bit, thereby, further complicating the designing of roller cone drill bits.

Because of the complexity of roller cone bit designs, accurate models of roller cone bits have not been widely developed or used to design roller cone bits. Instead, roller cone bits have largely been developed through trial and error. For example, if cutting elements on one cone of a prior art bit are shown to wear down faster that the cutting elements on another cone of the bit, a new bit design might be developed by simply adding more cutting elements to the cone that is known to wear faster in hopes of reducing the wear of each cutting element on that cone. Trial and error methods for designing roller cone bits have led to roller cone bits which have an imbalanced distribution of force on the bit. This is especially true for roller cone bits having cutting elements arranged to intermesh between adjacent cones.

One example of a prior art bit considered effective in the drilling wells is shown in FIGS. 3A–3D. This drill bit comprises a bit body 100 and three roller cones 110 attached to the bit body 100, such that each roller cone 110 is able to rotate with respect to the bit body 100 about an axis oblique to the rotational axis of the bit body 100. Disposed on each of the cones 110 is a plurality of cutting elements for cutting into an earth formation. As shown in FIGS. 4, 5 and 7, the cutting elements include primary cutting elements 112 and gage cutting elements 156. The cutting elements 112, 156 are arranged about the surface of each cone 110 in generally circular, concentric rows substantially perpendicular to the axis of rotation of the respective cone as illustrated for primary cutting elements 112 in FIG. 3C. In FIG. 3A, the profile of each row of cutting elements on each cone are shown in relation to each other to show the intermeshing of the cutting elements between adjacent cones. In this example, the cutting elements comprise milled steel teeth with hardface coating applied thereon. This type of drill bit is commonly referred to as a "milled tooth" bit.

As is typical for modern milled tooth roller cone bits, the teeth of the bit are arranged in three rows 114*a*, 114*b*, and 114*c* on the first cone 114, two rows 116*a* and 116*b* on the second cone 116, and two rows 118*a* and 118*b* on the third cone 118. As shown in FIG. 3A, at least one row of teeth on each cone is arranged to intermesh with a row of teeth on an adjacent cone. The first row 114*a* of the first cone 114 is located at the apex of the cone and is typically referred to as the spearpoint of the bit.

The drilling performance of this prior art bit was simulated and analyzed using a method described in a patent application filed in the United States on Mar. 13, 2000, entitled "Method for Simulating the Drilling of Roller Cone Drill Bits and its Application to Roller Cone Drill Bit Design and Performance" and assigned to the assignee of this invention. From this analysis, it was shown that this prior art bit has normalized cone rotation ratios for the first 114, second 116 and third 118 cones of 1.003:1.077:1, respectively, wherein the second cone 116 was found to rotate approximately 8% faster than the third cone 118. Other prior art bit designs with cutting elements intermeshing between the cones were found to have rotation ratios with differed by more than 8%. From the analysis of the bit shown in FIGS. 3A–3D, it was also observed that the scraping distance of the gage inserts 156 on each cone during drilling significantly differed between the cones. For some prior art bits, the differences between the scraping distance of the gage inserts on each cone is due, in part, to the differences between the rotation speeds of the cones.

BRIEF SUMMARY OF THE INVENTION

The invention is directed to a roller cone drill bit for drilling an earth formation. In one aspect, the drill bit includes a bit body, and a plurality of roller cones attached to the bit body and able to rotate with respect to the bit body. The bit further includes a plurality of cutting elements arranged on each of the roller cones so that cutting elements on adjacent cones intermesh between the adjacent cones. The cutting elements are arranged so that a rotation speed of each cone differs by less than about 7% from the rotation speed of each of the other cones during drilling.

In another aspect, the drill bit includes a bit body, and a plurality of roller cones attached to the bit body and able to rotate with respect to the bit body. The bit further includes a plurality of cutting elements arranged on each of the roller cones so that cutting elements on adjacent cones intermesh between the adjacent cones. At least one of the cutting elements on each cone is a gage cutting element. The gage cutting elements on each cone are arranged so that the scraping distance of the gage cutting elements on each cone is substantially the same as the scraping distance of the gage cutting elements on each of the other cones.

BRIEF DESCRIPTION OF THE DRAWINGS

FIG. 3C is a spacing diagram for a prior art bit.

FIG. 6 is a spacing diagram for a drill bit in accordance with one embodiment of the invention.

DETAILED DESCRIPTION

Figure 4:
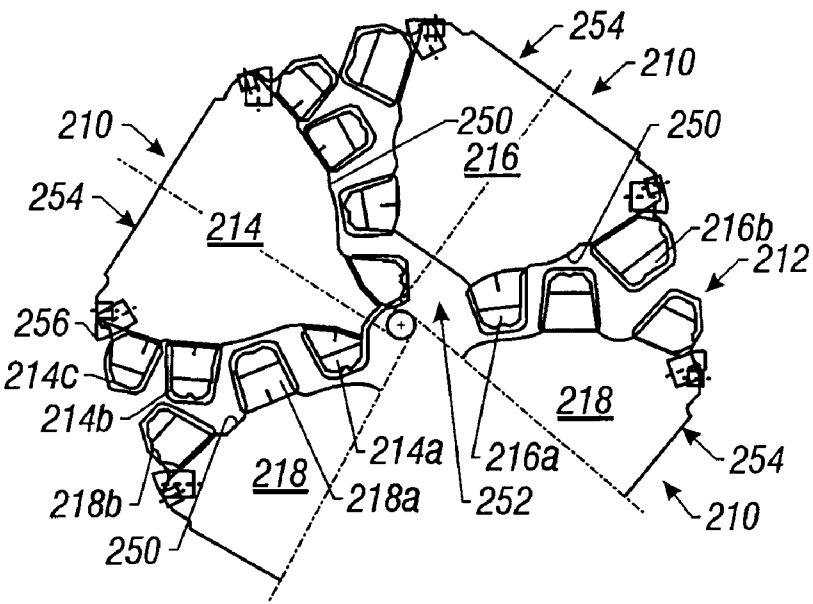
FIG. 4 is a diagram of the roller cones for a bit in accordance with one embodiment of the invention illustrating an intermeshing relationship of the cutting elements between the cones.
Figure 7:
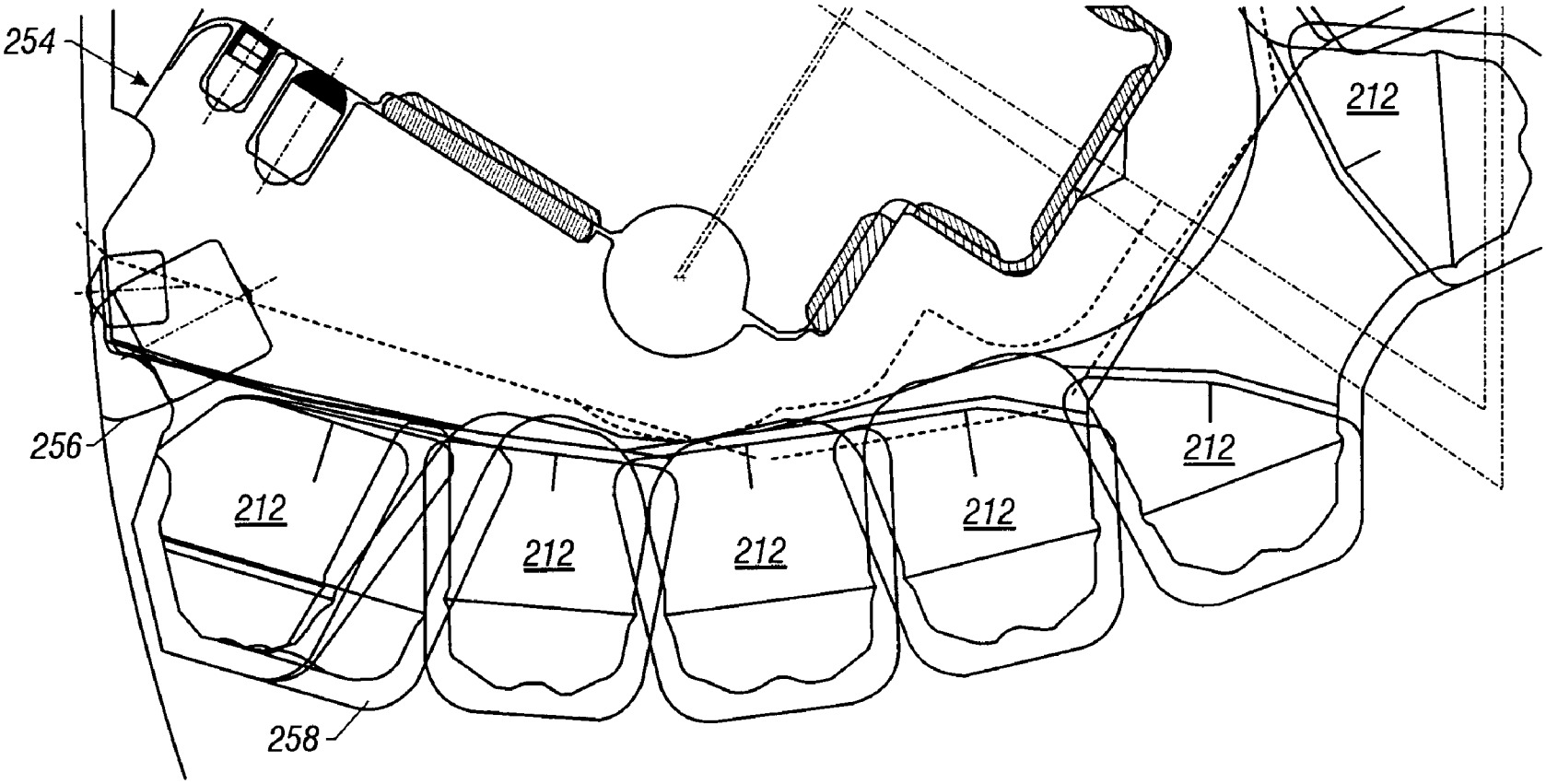
FIG. 7 is an enlarged partial view of the cone and cutting elements for an embodiment of the invention as shown in FIG. 5.

Referring to FIGS. 4–7, in one embodiment, the invention comprises a roller cone bit which includes a bit body 200 (partial view in FIG. 5) and plurality of roller cones (typically three), collectively referenced as 210 in FIG. 4. The roller cones 210 are attached to the bit body 200 and able to rotate with respect to the bit body 200. The roller cones 210 of the bit in this embodiment include a first cone 214, a second cone 216, and a third cone 218, as shown in FIG. 4. Each cone 214, 216, 218 includes an exterior surface, generally conical in shape having a side surface 250. Disposed about the side surface 250 of each cone 210 is a plurality of cutting elements, shown generally at 212 and additionally shown at 256. A distinction between cutting elements 212 and cutting elements 256 will be further explained.

The plurality of cutting elements 212, 256 disposed on each cone 210 is arranged primarily on the side surface 250 of each cone 214, 216, 218, as shown in FIG. 4. In general, at least three different types of cutting elements may be disposed on the cones 210, including primary cutting elements, generally indicated as 212, gage cutting elements, generally indicated as 256, and ridge cutting elements (not shown). In the embodiment of FIG. 4, primary cutting elements 212 are the cutting elements generally arranged about the side surface 250 of the cones and are used as the primary means for cutting through the bottomhole surface of the earth formation. Primary cutting elements 212 are arranged on each cone such that primary cutting elements 212 on adjacent cones intermesh between the cones. Gage cutting elements 256 are cutting elements which scrape the wall of the well bore to maintain the diameter of the borehole. Gage cutting elements 256 are typically arranged in one or more rows, often referred to as "gage rows", "heel rows" or "trucut", about the lower edge of one or more cones as shown at 256 in FIGS. 4, 5, and 7. Ridge cutting elements (not shown) are miniature cutting elements, typically comprising hardened material deposits, that are, optionally, disposed about the surface of a cone, typically between the primary cutting elements 212, to cut formation ridges which pass between larger cutting elements on the cone. Ridge cutting elements (not shown) are used to reduce damage or wear of the cone surface by reducing contact between the cone surface and the formation.

It should be understood that in a drill bit according to the invention, cutting elements may comprise primary cutting elements 212, gage cutting elements 256, and, optionally, ridge cutting elements (not shown). Further, while primary cutting elements 212 and gage cutting elements 256 are shown as distinctly different sets of cutting elements in this embodiment, it should be understood that in other embodiments, one or more primary cutting elements 212 may be disposed on one or more cones to essentially perform as a gage cutting element. The types and combinations of cutting elements used in specific embodiments of the invention are matters of choice for the bit designer and are not intended as limitations on the invention. Further, it should be understood that all cutting elements between adjacent cones may not necessarily intermesh. For example, in one embodiment, the cutting elements may be arranged in rows such that only one row of cutting elements on each cone intermeshes between the cones. The number of cutting elements and the arrangement of cutting elements that intermesh between adjacent cones are matters of choice for the bit designer.

FIG. 4 shows cone and cutting element configurations for this embodiment of the invention illustrating the location of the primary cutting elements 212 on each cone and the intermeshing of the primary cutting elements 212 between the cones. In this embodiment, the cutting elements are "teeth" such as milled steel teeth, but it should be understood that the invention is not limited to so called "milled tooth" drill bits. Other cutting elements such as tungsten carbide inserts or polycrystalline diamond compacts may, alternatively, be used in accordance with the invention.

In this embodiment, the cutting elements 212 are arranged in generally circular, concentric rows on the side surface 250 of each cone 214, 216, 218, as shown in FIGS. 4 and 6. On the first cone 214 the cutting elements 212 are arranged in three rows 214*a*, 214*b* and 214*c*. On the second cone 216 the cutting elements 212 are arranged in two rows 216*a* and 216*b*. On the third cone 218 the cutting elements 212 are arranged in two rows, 218*a* and 218*b*. The cutting elements are arranged so at least one row of cutting elements on each cone intermeshes with a row of cutting elements on an adjacent cone.

FIG. 6 illustrates the arrangement of the primary cutting elements 212 on the cones for this embodiment of the invention.

In this exemplary embodiment, the primary cutting elements 212, as previously explained comprise milled steel teeth formed on the cones. Hardface coating 258 is applied to the teeth (shown in more detail in FIG. 7) to produce a tooth cutting structure with increased hardness. In alternative embodiments, the cutting elements may comprise milled steel teeth without hardface coating, or alternatively, tungsten carbide inserts, or superhard inserts such as boron nitride or polycrystalline diamond compacts, or inserts with other hard coatings or superhard coatings applied there on, as determined by the bit designer.

It should also be understood that the number of cutting elements disposed on each cone as shown in FIG. 6 for this embodiment, is directed to the number of the primary cutting elements 212 disposed on the cones to cut the bottomhole surface of the well bore. The number and arrangement of gage cutting elements 256 in this embodiment is a matter of convenience for the bit designer. However, it is preferred that the gage cutting elements 256 be arranged such that the scraping distance traversed by the gage cutting elements 256 on each cone is substantially the same for each of the cones during drilling. Preferably, the gage cutting elements 256 are arranged on the cones such that the scraping distance of the gage cutting elements 256 on each cone is within about 10% of the scraping distance of the gage cutting elements 256 on each of the other cones. More preferably, the gage cutting elements 256 are arranged on the cones such that the scraping distance for each cone is within about 5%, and most preferably about 2% or less, of the scraping distance of the gage cutting elements 256 on each of the other two cones. The scraping distance of the gage cutting elements on each cone can be determined using a method for simulating the drilling performance of roller cone bits, such as the method described in the previously referred to patent application (filed in the United States on Mar. 13, 2000, entitled "Method for Simulating the Drilling of Roller Cone Drill Bits and Its Application to Roller Cone Drill Bit Design and Performance" and assigned to the assignee of this invention). Additionally, ridge cutting elements may, optionally, be disposed on the cone body as determined by the bit designer.

Figure 1:
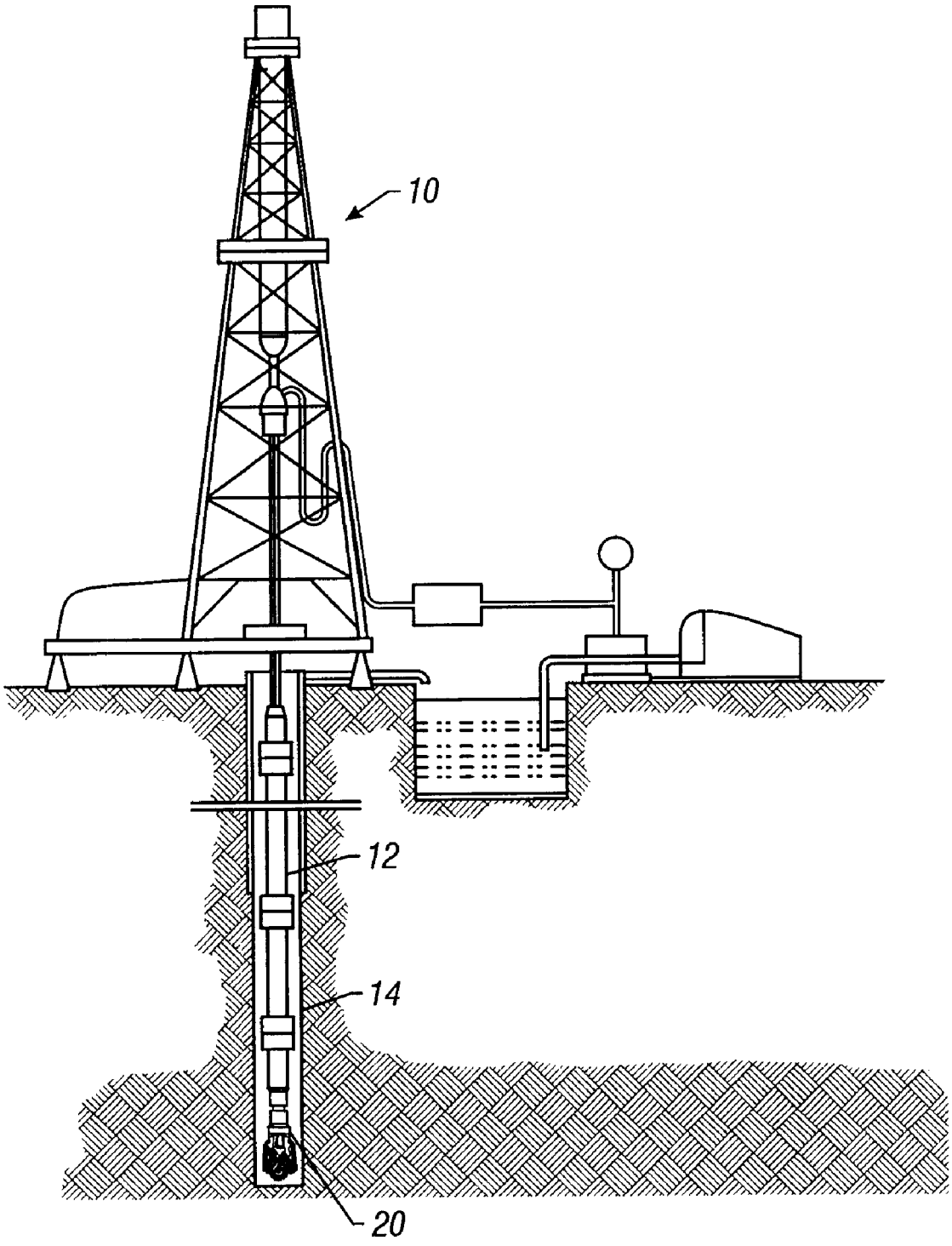
FIG. 1 (Prior Art)
FIG. 1 shows a schematic diagram of a drilling system for drilling earth formations.
Figure 2:
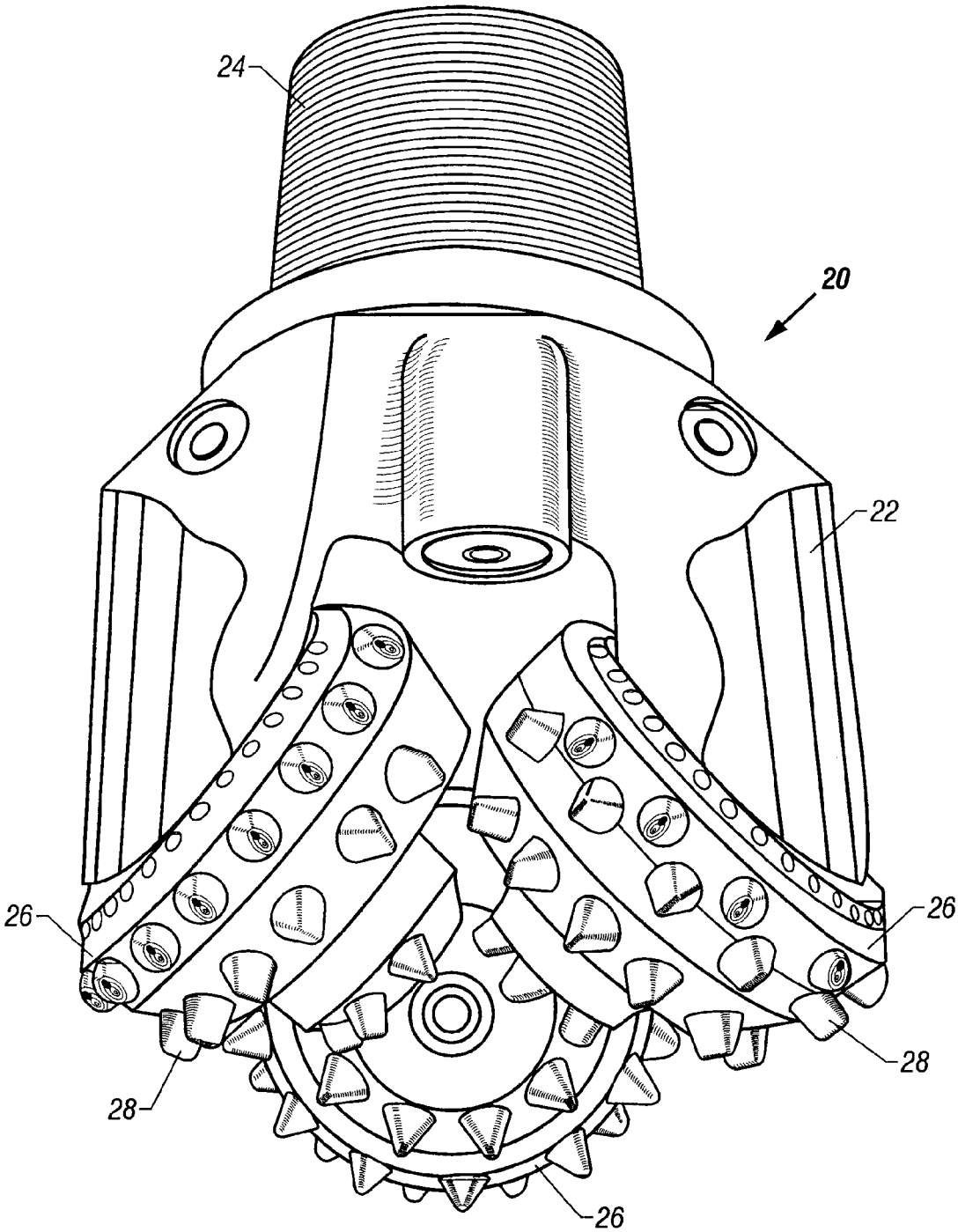
FIG. 2 (Prior Art)
FIG. 2 shows a perspective view of a prior art roller cone drill bit.
Figure 3B:
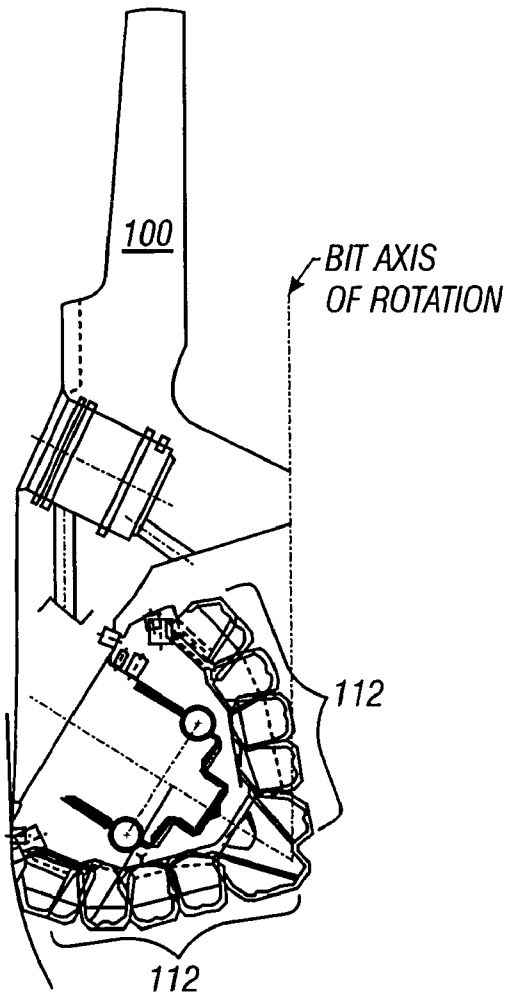
FIG. 3B (Prior Art)
FIG. 3B is a schematic diagram of one leg of a prior art bit wherein the effective position of cutting elements on all three cones of the bit are illustrated on the cone shown to illustrate bottomhole coverage of the bit.
Figure 3A:
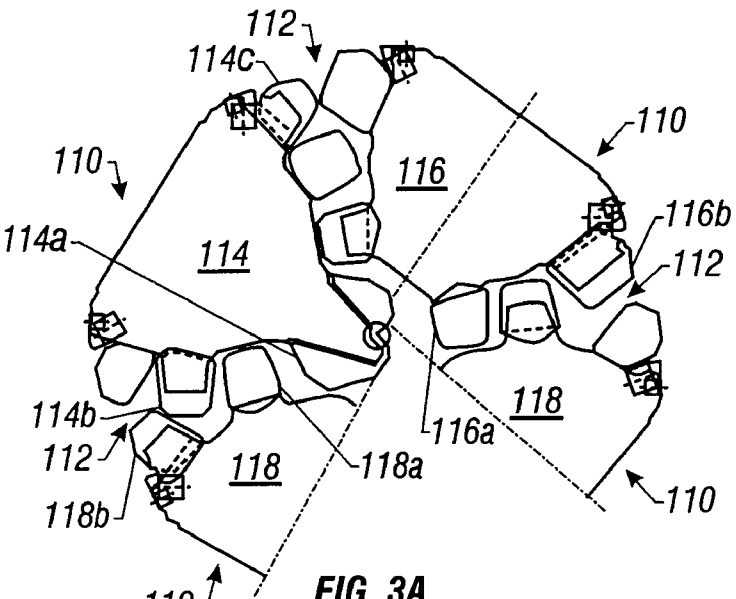
FIG. 3A (Prior Art)
FIG. 3A is a diagram of the roller cones of a prior art drill bit illustrating the intermeshing relationship of the cutting elements between the cones.
Figure 3D:
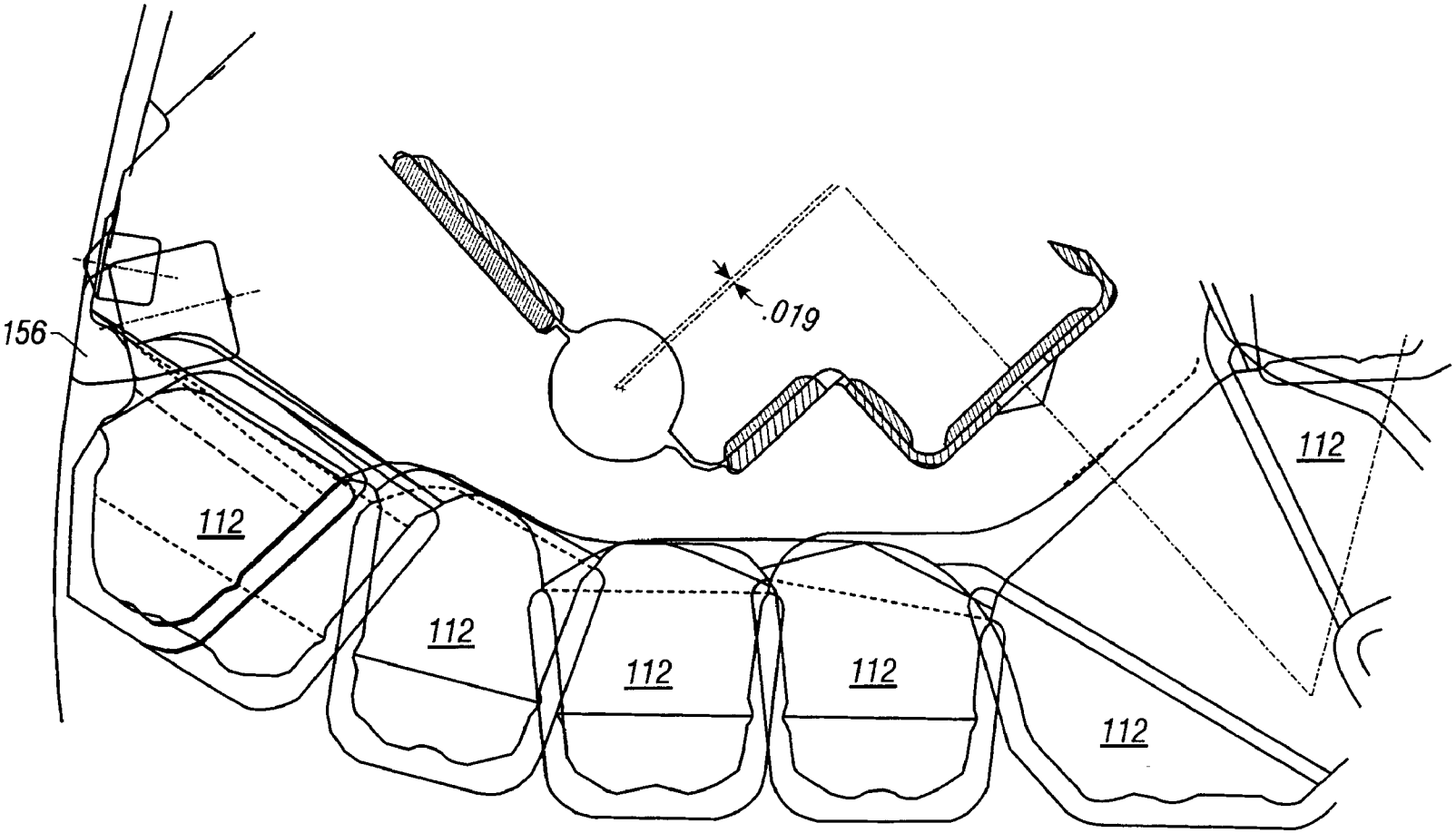
FIG. 3D is an enlarged partial view of the cone and cutting elements of the prior art bit shown in FIG. 3B.
Figure 5:
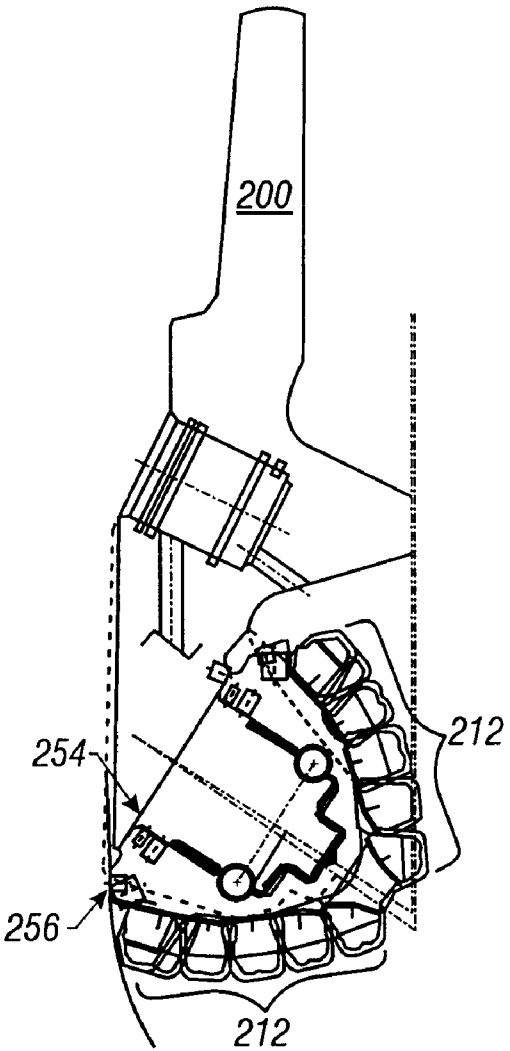
FIG. 5 is a schematic diagram of one leg of a drill bit configured in accordance with one embodiment of the present invention, wherein the effective position of cutting elements on all three cones of the bit are illustrated on the cone shown to illustrate bottomhole coverage of the bit.

Using the simulation method noted above, the drilling performance of the bit according to this embodiment was analyzed. From the analysis it was found that this bit provides several characteristics which represent improvements over prior art roller cone drill bits. Advantageously, a roller cone drill bit in accordance with the embodiment of FIGS. 4–7 provides an improved normalized cone rotation ratio (ratio of the rotation speeds of each cone). Prior art bit designs have been shown to have normalized cone rotation ratios which differ by more than 7% between the cones. For example, the prior art bit design of FIG. 3 exhibits cone rotation ratios of 1.003:1.077:1, normalized with respect to the slowest cone rotation. This leads to a maximum rotation rate difference between the cones of 7.7%. Having cones which rotate substantially at the same rate is desirable to equalize the wear of the cones during drilling. Advantageously, this embodiment provides improved normalized cone rotation ratios of 1.021:1.037:1. This leads to a maximum rotation ratio difference between the cones in this particular embodiment of less than 4%.

In this embodiment, the cutting elements are shown as arranged in rows on the side surface of each cone. In alternative embodiments of the invention, cutting elements may be arranged in any number of rows on each of the cones, or the cutting elements may not be arranged in rows, but instead placed in a different configuration about the surface of the cone, such as a staggered arrangement. It should be understood that the invention is not limited to the particular arrangement of the cutting elements shown in FIGS. 4–7, but rather the cutting elements may be arranged in any suitable manners as determined by the bit designer without departing from the spirit of the invention. Further, although a roller cone bit having three cones is shown for this embodiment, it should be understood that the invention is not limited to bits having three roller cones. The invention only requires that the bit have at least two roller cones. Additionally, although all of the above advantages were realized in this particular embodiment of the invention, it should be understood that other embodiments of the invention exist which may not include all these advantages together. Therefore, the invention is not intended to be limited to embodiments which include all of the advantages shown in the foregoing embodiment.

Reduced Maximum Normalized Cone Rotation Ratio

In another aspect, the invention comprises a drill bit having a bit body, and a plurality of roller cones attached to the bit body and able to rotate with respect to the bit body. The drill bit also includes a plurality of cutting elements arranged on each of the cones so that cutting elements on adjacent cones intermesh between the adjacent cones. Further, the cutting elements are arranged on the cones so that a rotation speed of each cone differs by less than 7% from the rotation speed of each of the other cones during drilling.

In one embodiment, the invention provides a bit structure wherein the cutting elements on the drive row of each cone of the bit are arranged so that the rotation speed of each cone differs by less than about 7% from the rotation speed of each of the other cones during drilling. In another embodiment, the cutting elements are arranged on the cone so that the rotation speed of each cone differs by less than about 5% from the rotation speed of each of the other cones. One example of a drill bit in accordance with this invention is shown in FIGS. 4–7 and discussed above. This embodiment provides a drill bit wherein each cone has a normalized cone rotation ratio of 1.02:1.04:1, respectively.

Advantageously, this aspect of the invention provides a drill bit with cutting elements arranged to intermesh between the cones while providing a bit with cone rotation speeds which differ by less than about 7% between cones.

Advantageously, a drill bit having an intermeshing cutting element configuration may provide higher cutting element protrusion to achieve good rates of penetration into the formation during drilling. Advantageously, a drill bit having cones which rotate at substantially the same rate during drilling can result in a more balanced distribution of wear between the cones and increased longevity of the bit.

For this aspect of the invention, the number of cutting elements and the arrangement of the cutting elements differ from that shown for the first embodiment, while still providing a drill bit with intermeshed cutting elements and cones with rotation speeds within about 7% of each other. For example, the spacing of the cutting elements may differ from that shown in the first embodiment. If in rows, the number of cutting elements on each row or the number of rows may differ from the number shown in the first embodiment. The type of cutting elements included on the bit may be different from that shown for the first embodiment. Additionally, gage cutting elements may be arranged on the cones as determined by a bit designer. Such additional characteristics of the bit are merely a matter of choice for the bit designer, and are not intended as a limitation on this aspect of the invention.

Scraping Distance of Gage Cutting Elements Balanced Between the Cones

In another aspect, the invention comprises a roller cone drill bit having a bit body and a plurality of roller cones attached to the bit body and able to rotate with respect to the bit body. The bit further includes a plurality of cutting elements disposed on each of the cones and arranged so that cutting elements on adjacent cones intermesh between the adjacent cones. In this aspect of the invention, at least one of the cutting elements on each cone comprises a gage cutting element. The gage cutting elements on the cones are arranged such that a scraping distance of the gage cutting elements on each cone is substantially the same for each of the cones.

In one embodiment, the gage cutting elements are arranged on the cones so that the scraping distance of the gage cutting elements on any one cone differs by less than about 10% from the scraping distance of the gage cutting elements on each of the other cones. In another embodiment, scraping distance of the gage cutting elements on each cone differs by less than about 5% of the scraping distance of the gage cutting elements on each of the other cones. In another embodiment, the scraping distance of the gage cutting elements on each cone differs by less than about 2% between the cones. The scraping distance of the gage cutting elements on a cone is a function of the rotation speed of the cone, and the location, spacing, size, and orientation of the gage row or heel row cutting elements. Thus, these factors can be adjusted as determined by one skilled in the art to substantially balance the scraping distance for the cones of the bit. As previously discussed, the gage cutting elements, as well as other cutting elements of the bit, may comprise milled steel teeth or inserts, such as tungsten carbide or polycrystalline diamond compacts, as determined by a bit designer. Advantageously, this aspect of the invention provides a drill bit with cutting elements arranged to intermesh between the cones while providing gage cutting elements on each cone arranged so that the scraping distance of the gage cutting elements on each cone is substantially the same for each of the cones. A drill bit having an intermeshed cutting element configuration may, advantageously, provide higher cutting element protrusion to achieve good rates of penetration during drilling. Equalizing the scraping distance of gage cutting elements between the cones may, advantageously, provide a more balanced distribution of lateral force and wear between the cones, which may lead to increased longevity of the bit.

For this aspect of the invention, the number of cutting elements and the arrangement of the cutting elements may be different than that shown for the first embodiment, while still maintaining a substantial balance between the scraping distance of the gage cutting elements on each cone. For example, the placement of primary cutting elements may differ from that shown for the first embodiment. If in rows, the number of cutting elements on each row or the number of rows may differ from the number shown in the first embodiment. The type of cutting elements included on the bit may be different from that shown for the first embodiment. Other cutting elements may be arranged on the cones as determined by a bit designer. Such additional characteristics of the bit are merely a matter of choice for the bit designer, and are not intended as a limitation on this aspect of the invention.

The invention has been described with respect to exemplary embodiments. It will be apparent to those skilled in the art that the foregoing description is only a few examples of embodiments of the invention, and that other embodiments of the invention can be devised which do not depart from the spirit of the invention. Additionally, while embodiments of the invention may include one or more of advantages as described above, the invention is not limited to these advantages. The invention shall be limited in scope only by the following claims.

What is claimed is:

1. A roller cone drill bit, comprising:

a bit body;

a plurality of roller cones attached to the bit body and able to rotate with respect to the bit body; and a plurality of cutting elements arranged on each of the cones so that cutting elements on adjacent cones intermesh between the adjacent cones, the cutting elements arranged so that a rotation speed of each cone differs by less than about 7% from the rotation speed of each of the other cones during a substantial portion of a drilling time.

2. The drill bit according to claim 1, wherein the rotation speed of each cone differs by less than about 5% from the rotation speed of each of the other cones during a substantial portion of a drilling time.

3. The drill bit according to claim 1, wherein the bit comprises three roller cones.

4. The drill bit according to claim 3, wherein each of the three cones has a normalized cone rotation ratio of about 1.02, 1.04, 1, respectively.

5. The drill bit according to claim 1, wherein the cutting elements comprise superhard inserts.

6. The drill bit according to claim 5, wherein superhard inserts comprise boron nitride.

7. The drill bit according to claim 5, wherein the superhard inserts comprise polycrystalline diamond compacts.

8. The drill bit according to claim 1, wherein the cutting elements comprise tungsten carbide inserts.

9. The drill bit according to claim 8, wherein the cutting elements further comprise a superhard material coating.

10. The drill bit according to claim 1, wherein the cutting elements comprise milled steel teeth.

11. The drill bit according to claim 10, wherein the cutting elements further comprise hardface coating.

12. The drill bit according to claim 1, wherein the plurality of cutting elements on each cone comprises at least one gage cutting element, the at least one gage cutting element being arranged on each cone such that a scraping distance of the at least one gage cutting element on each cone is substantially the same for each of the cones during a substantial portion of a drilling time.

13. The drill bit according to claim 12, wherein a difference between the scraping distance of the gage cutting elements on each cone is less than about 10% during a substantial portion of a drilling time.

14. The drill bit according to claim 12, wherein a difference between the scraping distance of the gage cutting elements on each cone is less than about 5% during a substantial portion of a drilling time.

15. The drill bit according to claim 12, wherein a difference between the scraping distance of the gage cutting elements on each cone is less than about 2% during a substantial portion of a drilling time.

16. A roller cone drill bit, comprising:

a bit body;

a plurality of roller cones attached to the bit body and able to rotate with respect to the bit body;

a plurality of cutting elements arranged on each of the cones so that cutting elements on adjacent cones intermesh between the adjacent cones, at least one of the cutting elements on each cone comprising a gage cutting element, the at least one gage cutting element on each cone being arranged such that a scraping distance of the at least one gage cutting element on each cone is substantially the same for each of the cones during a substantial portion of a drilling time.

17. The drill bit according to claim 16, wherein a difference between the scraping distance of the gage cutting elements on each cone is less than about 10% during a substantial portion of a drilling time.

18. The drill bit according to claim 16, wherein a difference between the scraping distance of the gage cutting elements on each cone is less than about 5% during a substantial portion of a drilling time.

19. The drill bit according to claim 16, wherein a difference between the scraping distance of the gage cutting elements on each cone is less than about 2% during a substantial portion of a drilling time.

20. The drill bit according to claim 16, wherein the cutting elements are arranged so that a rotation speed of each cone differs by less than about 7% from the rotation speed of each of the other cones during a substantial portion of a drilling time.

21. The drill bit according to claim 20, wherein the rotation speed of each cone differs by less than about 5% from the rotation speed of each of the other cones during a substantial portion of a drilling time.

22. The drill bit according to claim 16, wherein the bit comprises three roller cones.

23. The drill bit according to claim 22, wherein each of the three cones has a normalized cone rotation ratio of about 1.02, 1.04, 1, respectively.

24. The drill bit according to claim 16, wherein the cutting elements comprise superhard inserts.

25. The drill bit according to claim 24, wherein superhard inserts comprise boron nitride.

26. The drill bit according to claim 24, wherein the superhard inserts comprise polycrystalline diamond compacts.

27. The drill bit according to claim 16, wherein the cutting elements comprise tungsten carbide inserts.

28. The drill bit according to claim 27, wherein the cutting elements further comprise a superhard material coating.

29. The drill bit according to claim 16, wherein the cutting elements comprise milled steel teeth.

30. The drill bit according to claim 29, wherein the cutting elements further comprise hardface coating.

* * * * *